US005846098A

United States Patent [19]

Shiga et al.

[11] Patent Number: 5,846,098

[45] Date of Patent: Dec. 8, 1998

[54] CAPACITOR CONNECTING STRUCTURE AND CAPACITOR

[75] Inventors: Masaaki Shiga, Shizuoka-ken; Masahiro Suguro, Gotenba, both of Japan

[73] Assignee: Yazaki Corporation, Tokyo, Japan

[21] Appl. No.: 689,081

[22] Filed: Jul. 30, 1996

[30] Foreign Application Priority Data

Jul. 31, 1995 [JP] Japan ..... 7-194765

[51] Int. Cl.[6] ..... H01R 4/26

[52] U.S. Cl. ..... 439/409; 439/698

[58] Field of Search ..... 439/620, 621, 439/622, 830, 409, 698

[56] References Cited

U.S. PATENT DOCUMENTS 4,451,109 5/1984 Inoue ..... 439/830
5,082,458 1/1992 Poerschke ..... 439/621

FOREIGN PATENT DOCUMENTS 63-93045 6/1988 Japan .
3-62466 3/1991 Japan .
6-68916 3/1994 Japan .

*Primary Examiner*—Neil Abrams
*Assistant Examiner*—Eugene G. Byrd
*Attorney, Agent, or Firm*—Finnegan, Henderson, Farabow, Garrett & Dunner, L.L.P.

[57] ABSTRACT

The disclosed capacitor connecting structure can connect two wires to a capacitor simply, while reducing the numbers of parts and connecting steps required. The capacitor connecting structure comprises: a capacitor (27; 85; 141) having two electrodes on both sides thereof; two junction terminals (41; 95, 91; 149) each formed with a pressure-connecting terminal portion (31; 107; 151) pressure-connected to a wire, and an elastic terminal portion (37; 97; 153) electrically connected to an electrode of the capacitor; and an insulating material cover (29; 87; 143) for covering the capacitor and the two junction terminals, respectively. The two electrodes of the capacitor can be connected electrically to the two wires via the two junction terminals, respectively, by pressure-connecting the wire to the pressure-connecting terminal portion of the junction terminal, respectively.

16 Claims, 3 Drawing Sheets

CAPACITOR CONNECTING STRUCTURE AND CAPACITOR

BACKGROUND OF THE INVENTION

1. Field of the Invention

The present invention relates to a capacitor connecting structure and a capacitor connected to a wire or wires of a wire harness arranged in a vehicle body, for instance.

2. Description of the Related Art

In general, a capacitor for radio-noise prevention is connected to an automotive vehicle. One electrode of the capacitor is connected to a defogger circuit (used in common as an antenna) and the other electrode thereof is connected to a vehicle body for grounding.

In the prior art capacitor connecting structure, a capacitor is housed in an insulating housing. Further, one electrode of the housed capacitor is connected to an inner middle flat portion of a U-shaped capacitor terminal formed with two externally extending male terminal portions and fixed to the insulating housing. On the other hand, the other electrode of the housed capacitor is connected to a grounded terminal portion formed with a bolt hole and also fixed to the insulating housing. Therefore, when the grounded terminal portion is fixed to a vehicle body with a bolt passed through the bolt hole thereof, the insulating housing can be fixed to the vehicle body. Further, the two externally extending male terminals are connected to two female terminals clamped to two wires of the defogger circuit. Here, the two female terminals are housed in an external connector housing.

In connection of the capacitor with the two wires of the defogger circuit, the two externally extending male terminals of the U-shaped capacitor terminal are engaged with the two female terminals of the external connector housing.

As described above, in the prior art capacitor connecting structure, since the external connector housing is used, two wire clamping terminals clamped with the ends of the two wires and the connector housing are necessary, so that there exists a problem in that the number of parts to be connected between the capacitor and the two wires of the defogger circuit is large.

In addition, when the capacitor is connected to the two wires, since the two wires must be clamped with the two wire clamping terminals of the external connector, there exists a problem in that the number of capacitor connecting steps is large and thereby a capacitor connecting time is long.

Further, since the external connector housing is used to house the two wires of the defogger circuit, the area of the connecting portion becomes large, so that a large space is needed to fix the capacitor housing to the vehicle body.

SUMMARY OF THE INVENTION

With these problems in mind, therefore, it is the object of the present invention to provide a capacitor connecting structure and a capacitor, which can reduce the number of the parts thereof and the size of the connecting structure thereof, and simplify the connection work between the capacitor and the wires.

To achieve the above-mentioned object, the present invention provides a capacitor connecting structure, comprising: a capacitor (27; 85; 141) having two electrodes on both sides thereof; two junction terminals (41; 95, 91; 149) each formed with a pressure-connecting terminal portion (31; 107; 151) pressure-connected to a wire, and a terminal portion (37; 97; 153) connected to an electrode of said capacitor, both portions being formed integral with each other to electrically connect the two electrodes of said capacitor with two wires via said two junction terminals, respectively; and an insulating material cover (29; 87; 143) for covering said capacitor and said two junction terminals, respectively. Further, in the capacitor connecting structure, said insulating material cover is a casing (29) formed with: a capacitor accommodating portion (55) for accommodating said capacitor; two junction terminal accommodating portions (57) formed on both sides of the capacitor accommodating portion, for accommodating said two junction terminals, respectively; an opening portion (53) for inserting said capacitor and said junction terminals into said casing (29); a lid (65) for closing said opening portion of said casing (29); and two wire lead-out openings (61) for inserting the two wires to be electrically connected to said two junction terminals, respectively.

Further, in the capacitor connecting structure, each of said junction terminals (41) is formed with: an elastic terminal portion (37) electrically connected to an electrode of said capacitor; two parallel-arranged pressure-connecting terminal portions (31) pressure-connected to each wire; and when said two junction terminals (41) are accommodated in said casing, said capacitor is elastically sandwiched between said two elastic terminal portions (37) of said two junction terminals (41).

Further, in the capacitor connecting structure, said lid (65) is formed with: a closing portion (67) for closing the opening portion (53) of said casing (29); two wire pushing portions (69) each for pushing the wire against the pressure-connecting terminal portion (31) to electrically connect a conductor of the wire with said junction terminal, when said lid is closed to the opening (53) of said casing (29); and two junction terminal pushing projections (43) for locating said junction terminals in the junction terminal accommodating portions of said casing.

Further, in the capacitor connecting structure, said two junction terminals are a wire junction terminal (95) and a grounding junction terminal (91), and said insulating material cover is a casing (87) formed with: a capacitor accommodating portion (119) for accommodating said capacitor; a first junction terminal accommodating portion (113) formed on one side of said capacitor accommodating portion, for accommodating said wire junction terminal (95); a second junction terminal accommodating portion (105) formed on the other side of said capacitor accommodating portion, for accommodating said grounding junction terminal (91); an opening portion (115) for inserting said capacitor and said wire and grounding junction terminals; a lid (121) for closing said opening portion of said casing (87); a wire lead-out opening (133) for inserting the wire to be electrically connected to said wire junction terminal; and a grounding terminal lead-out opening (117) for leading out said grounding junction terminal.

Further, in the capacitor connecting structure, said wire junction terminal (95) is formed with: an elastic terminal portion (97) electrically connected to an electrode of said capacitor; and a pressure-connecting terminal portion (107) pressure-connected to a wire end; and said grounding junction terminal (91) is formed with: an elastic terminal portion (97) electrically connected to the other electrode of said capacitor; and a grounding terminal portion (99) having a fixing hole (101) and electrically connected to a vehicle body with a bolt; and when said wire and grounding junction terminals (95, 91) are accommodated in said casing, said capacitor is elastically sandwiched between said two elastic terminal portions (97) of said wire and grounding junction terminals (95, 91), respectively.

Further, in the capacitor connecting structure, said lid (121) is formed with: a closing portion (125) for closing the opening portion (115) of said casing (87); a wire pushing portion (127) for pushing the wire against the pressure-connecting terminal portion (107) of said wire junction terminal to electrically connect a conductor of the wire with said wire junction terminal when said lid is closed to the opening (115) of said casing (87); a grounding terminal pushing projection (131) for pushing said grounding junction terminal (91), when said lid is also closed to the opening (115) of said casing (87); and a plate portion (129) for closing the grounding terminal lead-out opening (117) of said casing (87).

Further, in the capacitor connecting structure, each of said two junction terminals (149) is formed with a pressure-connecting terminal portion (151) pressure-connected to a wire end, and with a terminal portion (153) fixed to an electrode of said capacitor, both portions being formed integral with each other to electrically connect the two electrodes of said capacitor with the two wires via said two junction terminals, respectively; and said insulating material is a heat shrinkable tube (143) for covering said capacitor and said two junction terminals, respectively when heated.

Further, the present invention provides a capacitor connected to at least one wire arranged on a vehicle body, which comprises two junction terminals (41; 95, 91; 149) each having a terminal portion (37; 97; 153) electrically connected to an electrode of the capacitor, and a pressure-connecting terminal portion (31; 107; 151) pressure-connected to the wire.

Further, in the capacitor, said two junction terminals (37; 149) are pressure-connected to two wires, respectively.

Further, in the capacitor, one of said two junction terminals (95) is pressure-connected to a wire and the other of said two junction terminal (91) is fixed to a grounded vehicle body.

Further, the capacitor further comprises an insulating material cover (29; 87; 149) for covering the capacitor and said two junction terminals, respectively.

As described above, in the capacitor connecting structure according to the present invention, since the capacitor can be connected to two wires by pressure-connecting the wire ends to the pressure-connecting terminal portions of the two junction terminals and by connecting the elastic terminal portions of the two junction terminals to the capacitor electrodes, it is possible to reduce the numbers of parts and the connecting steps, while decreasing the size of the junction portion between the capacitor and the wires.

DETAILED DESCRIPTION OF THE PREFERRED EMBODIMENTS

Some embodiments of the capacitor connecting structure according to the present invention will be described hereinbelow with reference to the attached drawings.

First embodiment

Figure 1A:
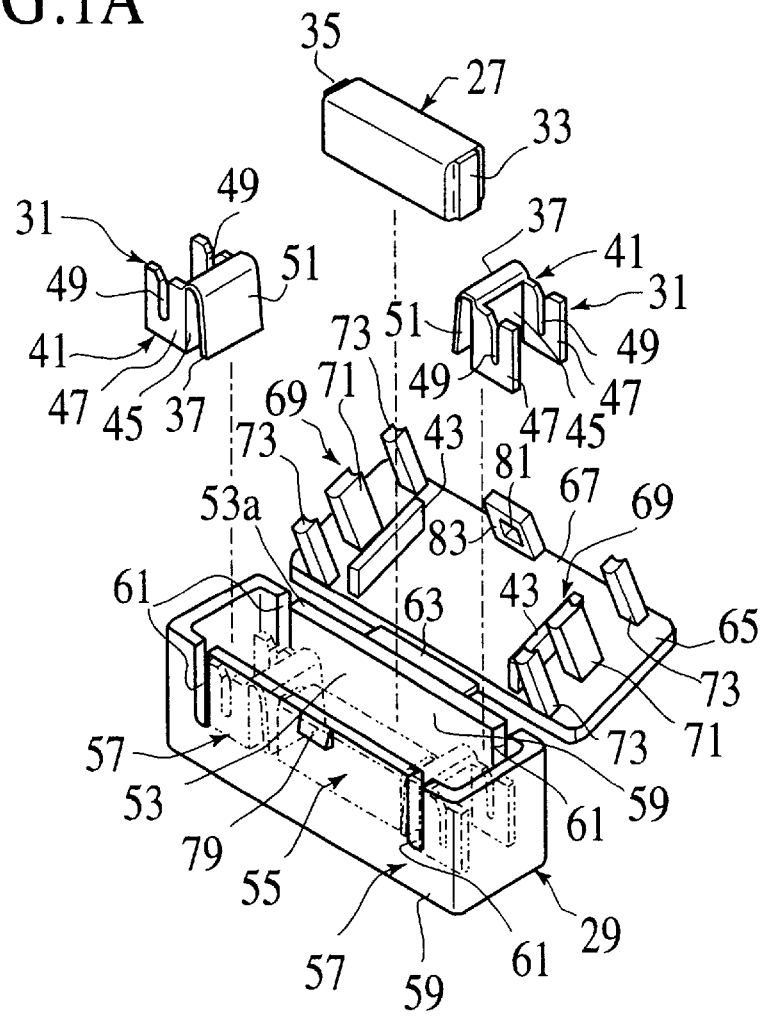
FIG. 1A is an exploded view showing a first embodiment of the capacitor connecting structure according to the present invention.
Figure 1B:
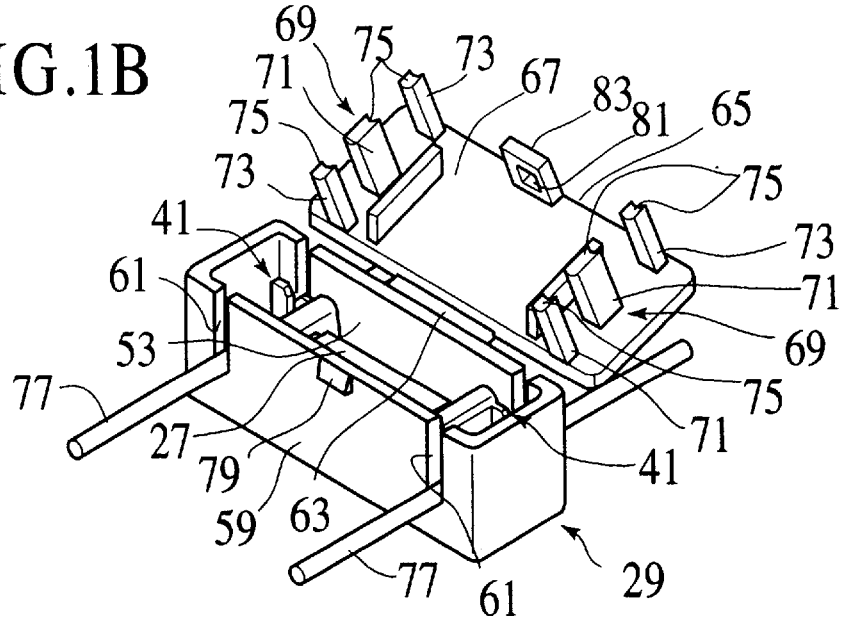
FIG. 1B is a perspective view showing the first embodiment of the capacitor connecting structure according to the present invention.

FIGS. 1A and 1B show the first embodiment thereof, in which a capacitor 27 and two junction terminals 41 are housed in a casing 29 (an insulating material cover).

Here, the capacitor 27 is formed with two end electrodes 33 and 35. Each of the two junction terminals 41 is formed with a pressure-connecting terminal portion 31 and a terminal portion 37 integral with each other. A wire 77 (as shown in FIG. 1B) is pressure connected to a pressure-connecting terminal portion 31 of the junction terminal 41. Further, one of the two end electrodes 33 and 35 is electrically connected to the terminal portion 37 of the junction terminal 41. Therefore, the feature of the capacitor connecting structure according to the present invention is to connect both the end electrodes 33 and 35 of the capacitor 27 to the two wires 77 via the two junction terminals 41, respectively.

In more detail, the pressure-connecting terminal portion 31 of each of the junction terminal 41 is formed by bending a flat-shaped conductive plate. The pressure-connecting terminal portion 31 is formed with two pressure-connecting plate portions 47 bend from both end of a base portion 45 at roughly right angles, and two wire pressure-connecting grooves 49 formed in the two pressure-connecting plate portions 47, respectively. Since the width of the upper opening of each pressure-connecting groove portion 49 increases gradually in the upward direction, when a wire covered with an insulating material is pressure-inserted into the opening of the pressure-connecting groove portion 49, the insulating material is directly cut off by the inner wall of the pressure-connecting groove portion 49, so that the conductor of the wire can be connected to the pressure-connecting plate portion 47 of the junction terminal 41 electrically.

Further, the terminal portion 37 of the junction terminal 41 is formed by bending an elastic plate portion 51 from the base portion 45 on one side and between the two pressure-connecting plate portions 47. The formed elastic plate portion 51 of the junction terminal 41 is connected to one of the two electrodes 33 and 35 formed on both sides of the capacitor 27. Further, in this first embodiment, the two junction terminals 41 are arranged on both sides of the capacitor 27 within the casing (the insulating material cover) 29, so that the capacitor 27 can be sandwiched elastically between the two elastic plate portions 51 of the two junction terminals 41.

The casing 29 is a box body formed of an insulating material, and an opening portion 53 is formed on one surface thereof. Further, the casing 29 is formed with a capacitor accommodating portion 55 at a middle portion thereof and two junction terminal accommodating portions 57 on both side of the capacitor accommodating portion 55, respectively. Further, the casing 29 is formed with two wire lead-out openings 61 near both side walls 59 for forming the capacitor accommodating portion 55, respectively.

Further, a lid 65 is formed integral with one edge portion of the opening portion 53 of the casing 29 so as to be connected thereto via a hinge 63. The lid 65 is formed with an enclosed portion 67 for closing all the area of the opening portion 53 of the casing, and two wire pushing portions 69 on both sides of the closing portion 67 at such positions as to correspond to the two junction terminal accommodating portions 57, respectively. Each of the two wire pushing portions 69 is composed of a middle wire pressure-connecting projection 71 for pressure-connecting the wire 77 to the junction terminal 41, and two side wire pushing projections 73 formed on both sides of the middle wire pressure-connecting projection 71. An arc-shaped cutout portion 75 (See FIG. 1B) is formed at each end surface of the middle wire pressure-connecting projection 71 and the two side wire pushing projections 73, respectively in such a way as to be brought into contact with a part of the outer circumferential surface of the wire 77 when the lid 65 is closed. In addition, the lid 65 is formed with two junction terminal pushing projections 43 between the two wire pushing portions 69 in such a way as to be brought into contact with the upper portions of the two junction terminals 41 to locate the two junction terminals 41 at the junction terminal accommodating portions 57 of the casing 29, respectively when the lid 65 is closed relative to the opening portion 53 of the casing 29.

Further, an engage projection 79 is formed integral with the casing 29 at the opening edge thereof. On the other hand, a flexible engage frame portion 83 having an engage hole 81 engaged with the engage projection 79 is formed integral with the lid 65. Therefore, when the lid 65 is closed relative to the opening portion 53 of the casing 29, since the engage projection 79 is engaged with the engage hole 81 of the flexible engage frame portion 83, the lid 65 is kept closed to the casing 53.

The procedure of connecting the capacitor 27 with the two wires 77 by use of the two junction terminals 41 will be described hereinbelow.

First, the two junction terminals 41 are arranged in the junction terminal accommodating portions 57 of the casing 29, respectively. Then, the capacitor 27 is housed in the capacitor accommodating portion 55 of the casing 29.

In this case, the capacitor 27 can be sandwiched elastically between the two elastic plate portions 51 of the two junction terminals 41 by deforming the elastic plate portions 51 thereof, so that the two end electrodes 53 of the capacitor 27 can be brought into elastic contact with the two elastic plate portions 51 of the two junction terminals 41, respectively.

Secondly, the two wires 77 to be connected are mounted on the pressure-connecting terminal portions 31 of the two junction terminal 41. After that, the lid 121 is pivoted closed toward the opening portion 53 of the casing 29 to close the casing 29. In this case, since the wires 77 are brought into tight contact with cut-out portions 75 of the wire pushing portions 69 of the lid 65, when the lid 65 is closed, the wires 77 can be brought into tight contact with the pressure-connecting grooves 111 of the pressure-connecting terminal portion 31 of the junction terminal 41, so that the insulating material of the wire is cut off and thereby the wire conductor is brought into contact with the junction terminal, respectively. As a result, the wires 77 can be electrically connected to the capacitor 85 via the two junction terminal 41, electrically and respectively.

After that, when the casing 29 is closed by the lid 65 perfectly, the engage hole 81 of the flexible engage frame portion 83 of the lid 65 can be engaged with the engage projection 79 of the casing 29.

In the first embodiment of the capacitor connection structure according to the present invention, since the capacitor 27 can be connected to the two wires 77 by pressure connecting the wires 77 with the pressure-connecting terminal portions 31 of the two junction terminals 41, it is possible to eliminate a connector housing and two wire clamping terminals housed in the connector housing so far needed in the prior art capacitor connecting structure, with the result that the number of connecting parts and the number of capacitor connecting steps can be both reduced.

In addition, since no special jig is required when the two wires 77 are pressure-connected to the pressure-connecting terminal portions 31 of the junction terminals 41; that is, since the wires 77 can be pressure-connected to the junction terminals 44, when the lid 53 is closed to the opening portion 53 of the casing 29, the connection work between the capacitor 27 and the two wires 77 can be facilitated.

Further, since no connector housing is used, it is possible to eliminate a large space for mounting the connector housing on a vehicle body. Furthermore, since the capacitor 27 can be connected to any wires of a vehicle circuit, by simply cutting off the wires and bringing both ends of the cut-off wires into pressure contact with the pressure-connecting terminal portions 31 of the junction terminals 41, the connection work between the capacitor 27 and the two wires 77 can be facilitated markedly.

Second embodiment

Figure 2A:
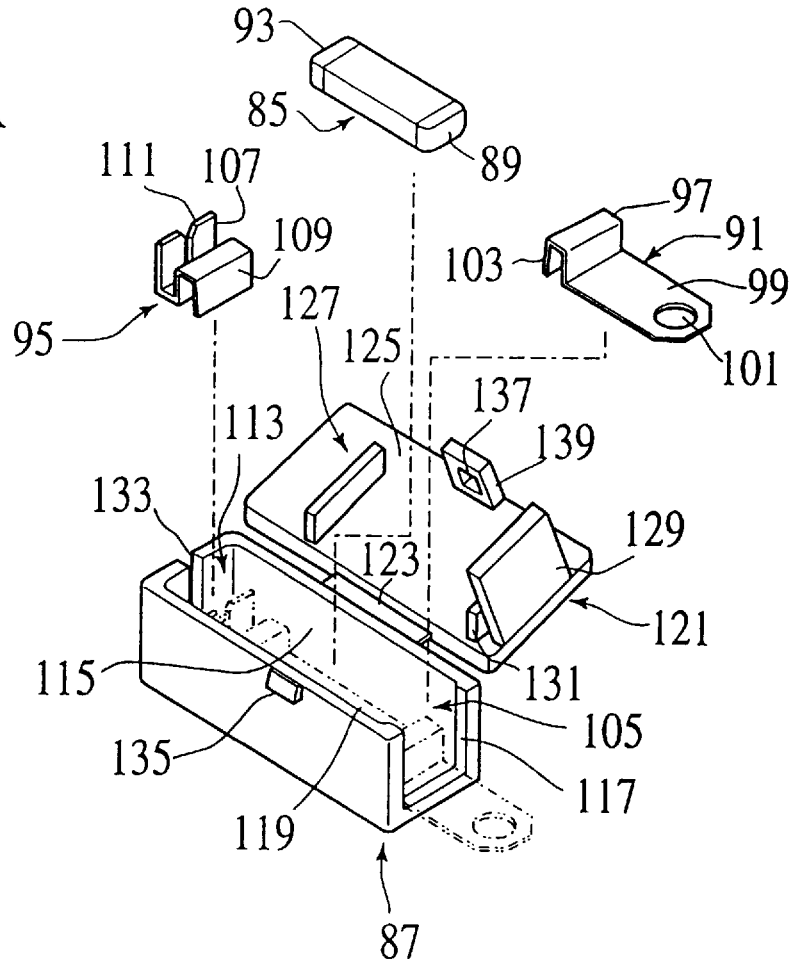
FIG. 2A is an exploded view showing a second embodiment of the capacitor connecting structure according to the present invention.
Figure 2B:
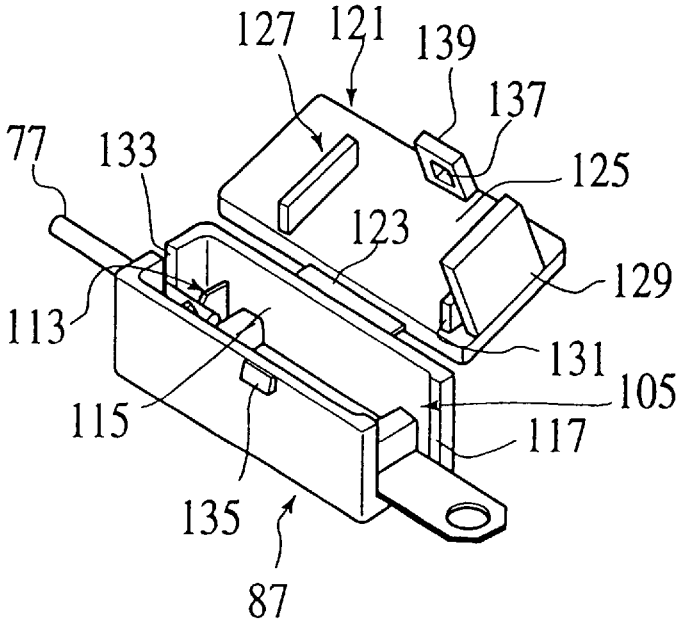
FIG. 2B is a perspective view showing the second embodiment of the capacitor connecting structure according to the present invention.

FIGS. 2A and 2B show the second embodiment thereof, in which a capacitor 85 and a wire junction terminal 95 and a grounding junction terminal 91 are housed in a casing 87 (an insulating material cover).

That is, this second embodiment is different from the first embodiment in that one of two junction terminals 91 brought into contact with one of the capacitor electrodes 89 is used as the grounding junction terminal, and the other of two junction terminals 95 brought into contact with one of the capacitor electrodes 93 is used as that similar to that of the first embodiment.

The grounding junction terminal 91 formed by bending a conductive flat-shaped plate is formed with a U-shaped elastic terminal portion 97 on one side thereof and a grounding terminal portion 99 on the other side thereof. Further, a fixing hole 101 is formed in the grounding terminal portion 99, and an elastic plate portion 103 is formed at an end of the terminal portion 97. The grounding junction terminal 91 is arranged in a junction terminal accommodating portion 105 of the casing 87. On the other hand, the junction terminal 95 is formed with a pressure-connecting terminal portion 107 on one side thereof and an elastic plate portion 109 on the other side thereof. Further, a pressure-connecting groove 111 is formed in the pressure-connecting terminal portion 107. The junction terminal 95 is arranged in the junction terminal accommodating portion 113 of the casing 87.

In the junction terminal 95, the direction of the pressure-connecting groove 111 is different from that of the pressure-connecting groove 49 of the junction terminal 41 of the first embodiment. In more detail, in the junction terminal 41 of the first embodiment, the pressure-connecting groove 49 is formed in a direction perpendicular to the direction in which the capacitor 27 is sandwiched between the two junction terminals 31. In this second embodiment, however, the pressure-connecting groove 111 is formed in a direction in which the capacitor 85 is sandwiched between the wire and grounding junction terminals 95 and 91.

The casing 87 is a box body formed of an insulating material. An opening portion 115 is formed on an upper surface of the casing 87 and another opening (grounding terminal lead-out) portion 117 is formed on one side surface thereof. Further, the casing 87 is formed with a capacitor accommodating portion 119 at a middle portion thereof, a first junction terminal accommodating portion 113 for accommodating the wire junction terminal 95, and a second junction terminal accommodating portion 105 for accommodating the grounding junction terminal 91. Here, the second junction terminal accommodating portion 105 for the grounding junction terminal 91 is formed on the side of the grounding terminal lead-out opening portion 117 in such a way that the grounding terminal portion 99 of the grounding junction terminal 91 arranged in the junction terminal accommodating portion 105 of the casing 87 projects outward from the grounding terminal lead-out opening portion 117.

In addition, a lid 121 is formed integral with one edge portion of the opening portion 115 of the casing 87 so as to be connected thereto via a hinge 123. The lid 121 is formed with an enclosed portion 125 for closing all the area of the opening portion 115 of the casing 87, a wire pushing portion 127 formed on one side of the closing portion 125 to push the wire junction terminal 95, a grounding terminal pushing projection 131 formed on the other side of the closing portion 125 to push the grounding junction terminal 91, and a plate portion 129 formed on the outside of the grounding terminal pushing projection 131 to close the grounding terminal lead-out opening 117 of the casing 87. Further, a wire lead-out opening 133 is formed on a side surface of the casing on the side of the first junction terminal accommodating portion 113.

Further, an engage projection 135 is formed integral with the casing 87 at the opening edge thereof. On the other hand, a flexible engage frame portion 139 having an engage hole 137 engaged with the engage projection 135 is formed integral with the lid 121. Therefore, when the lid 121 is closed relative to the opening portion 115 of the casing 87, since the engage projection 135 is engaged with the engage hole 137 of the flexible engage frame portion 139, the lid 121 is kept closed to the casing 87.

The procedure of connecting the capacitor 85 between a wire 77 and the ground by use of the two junction terminals 95 and 91 will be described hereinbelow.

First, the wire junction terminal 95 is arranged in the first junction terminal accommodating portion 113 of the casing 87, and the grounding junction terminal 91 is arranged in the second grounding junction terminal accommodating portion 105 of the casing 87. In this case, the grounding terminal portion 99 of the grounding junction terminal 91 projects outward from the opening 117 of the casing 87. Then, the capacitor 85 is accommodated between the wire junction terminal 95 and the grounding junction terminal 91. In this case, the two electrodes 93 and 89 of the capacitor 85 are elastically sandwiched between the two elastic plate portions 109 and 103 of the wire junction terminal 95 and the grounding junction terminal 91.

Under these conditions, after the wire 77 is mounted on the pressure-connecting terminal portion 107 of the wire junction terminal 95, the lid 121 is pivoted closed to the opening portion 115 of the casing 87. Therefore, the wire 77 is pushed by the wire pushing portion 127 of the lid 121, so that the wire 77 is pushed into the pressure-connecting groove 111 of the pressure-connecting terminal portion 107 of the wire junction terminal 95. As a result, since the insulating cover of the wire 77 can be cut off and thereby a wire inductor is connected with the wire junction terminal 95, the wire 77 can be connected to the capacitor 85 via the wire junction terminal 95.

Further, when the lid 121 is pivoted closed to the opening portion 115 of the casing 87, the grounding terminal lead-out opening portion 117 of the casing 87 is closed by the plate portion 129 of the lid 121. In this case, the grounding terminal portion 99 of the grounding junction terminal 91 projects outward from the opening 117 of the casing 87. Further, when the engage projection 135 of the casing 87 is engaged with the engage hole 137 of the flexible engage frame portion 139 of the lid 121, the wire junction terminal 95, the grounding junction terminal 91 and the capacitor 85 are all housed in the casing 87. Further, when the grounding terminal portion 99 is fixed to a vehicle body by use of a bolt, the casing 87 can be fixed to the vehicle body securely.

In the second embodiment of the capacitor connecting structure according to the present invention, since the capacitor 85 can be connected to the two wire 77 by pressure-connecting the wire 77 with the pressure-connecting terminal portion 107 of the wire junction terminal 95, it is possible to eliminate a connector housing and two wire clamping terminals so far needed in the prior art capacitor connecting structure, with the result that the number of connecting parts and the number of connecting steps can be both reduced.

In addition, since no special jig is required when the wire 77 is pressure-connected to the pressure-connecting terminal portion 107 of the wire junction terminal 95; that is, since the wire 77 can be pressure-connected to the wire junction terminal 95 when the lid 121 is closed to the opening portion 115 of the casing 87, the connection work between the capacitor 85 and the wire 77 can be facilitated. Further, since no connector housing is used, it is possible to eliminate a large space for mounting the connector housing on a vehicle body.

Furthermore, when the grounding terminal portion 99 of the grounding junction terminal 91 is fixed to the vehicle body, the capacitor 85 can be grounded and further fixed to the vehicle body at the same time.

Third embodiment

Figure 3A:
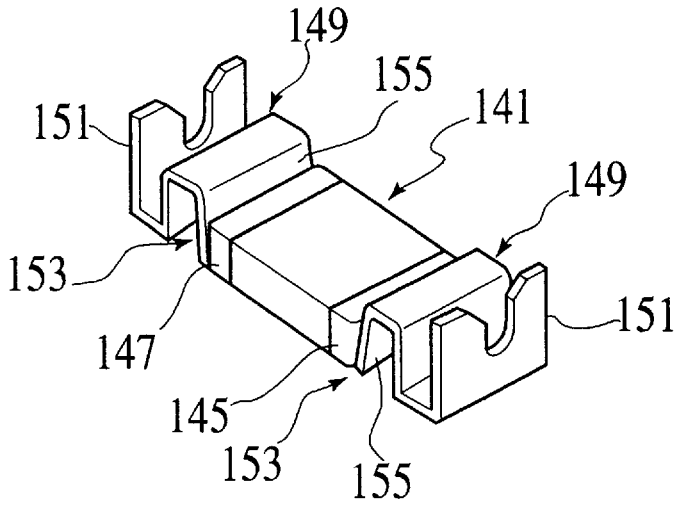
FIG. 3A is a perspective view showing two junction terminals used for a third embodiment of the capacitor connecting structure according to the present invention.
Figure 3B:
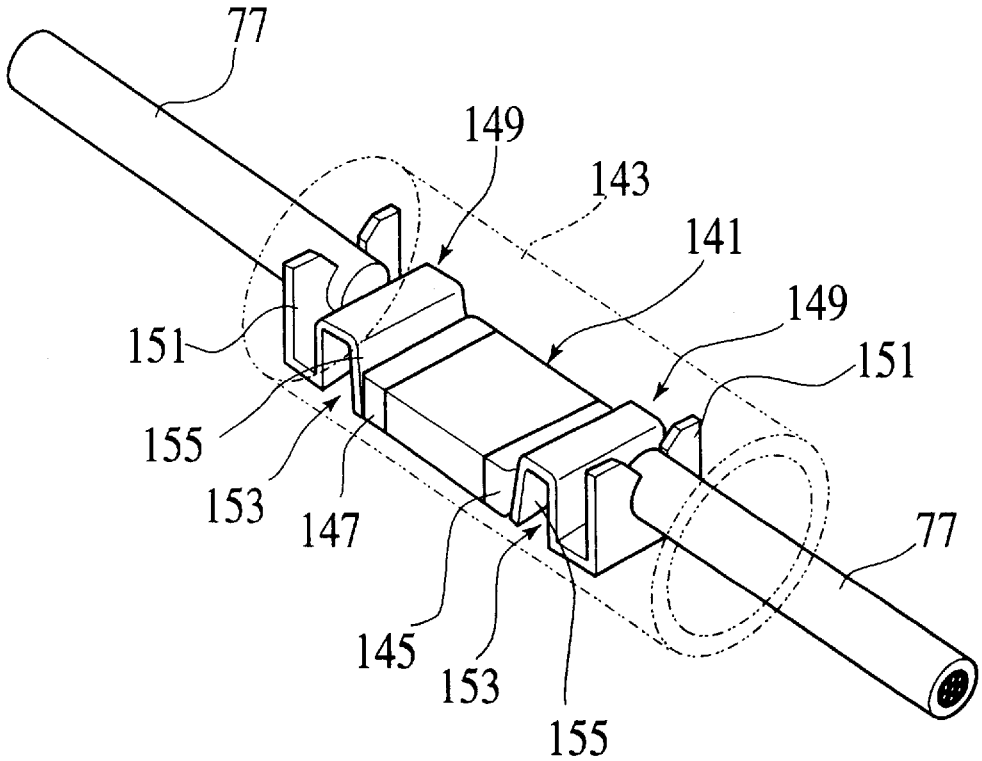
FIG. 3B is a perspective view showing two junction terminals covered with a heat shrinkable tube of the third embodiment of the capacitor connecting structure according to the present invention.

FIGS. 3A and 3B show the third embodiment thereof, in which a capacitor 141 is sandwiched by two junction terminals 149 and further covered by an insulating material cover such as a heat shrinkable tube 143.

In more detail, in this embodiment of the capacitor connecting structure, two junction terminals 149 are fixed to both electrodes 145 and 147 of the capacitor 141 by soldering. Further, each of the junction terminals 149 is formed with a pressure-connecting terminal portion 151 on the outer side thereof and with a terminal portion 153 on the inner side thereof. Further, a contact plate portion 155 of the terminal portion 153 of the junction terminal 149 is soldered to the electrode 145 or 147 of the capacitor 141.

To connect two wires 77 with the capacitor 141, both ends of the two wires 77 are pressure-connected to the two pressure-connecting terminal portions 151 of the two junction terminals 149 fixed to both the electrodes 145 and 147 of the capacitor 141. Therefore, it is possible to connect the capacitor 141 to the two wires 77 via the two junction terminals 149.

After that, a heat shrinkable tube 143 previously fitted to one of the wires 77 is moved in the axial direction of the wires 77 to such a position as to cover the capacitor 141 and the two junction terminals 149. Under these conditions, when heated, the heat shrinkable tube 143 shrinks, so that the capacitor 141 and the two junction terminals 149 are all covered by the heat shrinkable tube 143. Here, since the heat shrinkable tube 143 shrinks when heated, the heat shrinkable tube 143 is brought tight contact with the outer surfaces of the capacitor 141 and the two junction terminals 149.

In the third embodiment of the present invention, since the two wires 77 can be connected to the capacitor 141, by simply pressure-connecting the two wires 77 with the two pressure-connecting terminal portions 151 of the two junction terminals 149, clamping terminals attached to the wires and a connector housing for housing these clamping terminals are not required, so that it is possible to reduce the number of parts for connecting the capacitor to the wires.

Further, since the number of connecting steps such as connector assembly work, wire clamping work to the wire ends, etc. are all eliminated, it is possible to facilitate the capacitor connecting work.

In addition, since no casing for housing the capacitor 141 and the two junction terminals 149 are not required, in comparison with the first and second embodiments, the size of the capacitor connecting structure can be further reduced, so that the space for mounting the capacitor can be further reduced.

As described above, in the capacitor connecting structure according to the present invention, since the capacitor can be connected to two wires by pressure-connecting the wire ends to the pressure-connecting terminal portions of the two junction terminals and by connecting the elastic terminal portions of the two junction terminals to the capacitor electrodes, it is possible to reduce the numbers of parts and the connecting steps, while decreasing the size of the junction portion between the capacitor and the wires.

What is claimed is:

1. A capacitor connecting structure, comprising:

a capacitor having two electrodes, the electrodes being on opposite sides of the capacitor from each other;

two junction terminals each having a pressure-connecting terminal portion pressure-connected to a wire, and a terminal portion connected to an electrode of the capacitor, the pressure-connecting portion and the terminal portion being integral with each other to electrically connect the two electrodes of the capacitor with two wires via the two junction terminals, respectively; and an insulating material cover for covering the capacitor and the two junction terminals, respectively.

2. The capacitor connecting structure of claim 1, wherein the insulating material cover is a casing having:

a capacitor accommodating portion for accommodating the capacitor;

two junction terminal accommodating portions on the two sides of the capacitor accommodating portion, for accommodating the two junction terminals, respectively;

an opening portion for inserting the capacitor and the junction terminals into the casing;

a lid for closing the opening portion of the casing; and two wire lead-out openings for inserting the two wires to be electrically connected to the two junction terminals, respectively.

3. The capacitor connecting structure of claim 2, wherein:

the terminal portion is elastic;

the pressure-connecting terminal portions are arranged in parallel; and the capacitor is elastically sandwiched between the two elastic terminal portions of the two junction terminals.

4. The capacitor connecting structure of claim 3, wherein the lid comprises:

two wire pushing portions each for pushing the wire against the pressure-connecting terminal portion to electrically connect a conductor of the wire with the junction terminal, when the lid closes the opening of the casing; and two junction terminal pushing projections for locating the junction terminals in the junction terminal accommodating portions of the casing.

5. The capacitor connecting structure of claim 3, wherein the insulating cover is a casing having:

a capacitor accommodating portion for accommodating the capacitor;

a first junction terminal accommodating portion on one side of said capacitor accommodating portion, for accommodating the wire junction terminal;

a second junction terminal accommodating portion on the opposite side of said capacitor accommodating portion, for accommodating the grounding junction terminal;

an opening portion for inserting the capacitor and the wire and grounding junction terminals;

a lid for closing the opening portion of the casing;

a wire lead-out opening for inserting the wire to be electrically connected to the wire junction terminal; and a grounding terminal lead-out opening for leading out the grounding junction terminal.

6. The capacitor connecting structure of claim 5, wherein: the wire junction terminal having:

an elastic terminal portion electrically connected to the electrode on one side of the capacitor; and a pressure-connecting terminal portion pressure-connected to a wire end; and the grounding junction terminal having:

an elastic terminal portion electrically connected to the electrode on the opposite side of the capacitor; and the grounding terminal portion having a fixing hole for electrical connection to a vehicle body with a bolt; and the capacitor being elastically sandwiched between the two elastic terminal portions of the wire and grounding junction terminals, respectively.

7. The capacitor connecting structure of claim 6, wherein the lid comprises:

a closing portion for closing the opening portion of the casing;

a wire pushing portion for pushing the wire against the pressure-connecting terminal portion of the wire junction terminal to electrically connect a conductor of the wire with the wire junction terminal when the lid closes the opening of the casing;

a grounding terminal pushing projection for pushing the grounding junction terminal, when the lid is closed; and a plate portion for closing the grounding terminal lead-out opening of the casing.

8. The capacitor connecting structure of claim 1, wherein each of the two junction terminals comprises a pressure-connecting terminal portion pressure-connected to a wire end, and a terminal portion fixed to an electrode of the capacitor, the pressure-connecting portion and the terminal portion being integral with each other to electrically connect the two electrodes of the capacitor with the two wires via the two junction terminals, respectively; and the insulating material is a heat shrinkable tube for covering the capacitor and the two junction terminals, respectively, when heated.

9. A capacitor connecting structure connected to at least one wire arranged on a vehicle body, comprising two junction terminals each having a terminal portion electrically connected to an electrode of the capacitor, and at least one having a pressure-connecting terminal portion pressure-connected to the wire.

10. The capacitor connecting structure of claim 9, wherein the two junction terminals are pressure-connected to two wires, respectively.

11. The capacitor connecting structure of claim 9, wherein one of the two junction terminals is pressure-connected to a wire and the other of the two junction terminals is fixed to a grounded vehicle body.

12. The capacitor connecting structure of claim 9, further comprising an insulating material cover for covering the capacitor and the two junction terminals, respectively.

13. A capacitor connecting structure, comprising:

a capacitor having two electrodes, the electrodes being on opposite sides of the capacitor from each other;

a wire junction terminal having a terminal portion connected to an electrode on one of the opposite sides of the capacitor, and having a pressure-connecting portion for forming a pressure connection with a wire;

a grounding junction terminal having a terminal portion connected to an electrode on the other of the opposite sides of the capacitor, and having a grounding terminal portion for connection to ground; and an insulating cover for covering the capacitor and the two junction terminals, respectively.

14. A capacitor connection structure comprising:

an insulator comprising a single connected flexible member; and a capacitor circuit completely enclosed by the insulator, the capacitor circuit comprising:

a capacitor having first and second electrodes different in polarity from each other;

a first circuit connected to the first electrode, the first circuit including:

a first contact contacting the first electrode;

a first terminal conductive to the first contact; and a terminal end of an insulated electric wire contacting the first terminal; and a second circuit connected to the second electrode, the second circuit including:

a second contact connected to the first electrode;

a second terminal conductive to the second contact; and a portion of a conductor connected to the second terminal.

15. A capacitor connection structure comprising:

a flexible first insulator; and a capacitor circuit totally enclosed by the first insulator, the capacitor circuit comprising:

a capacitor having a first and a second electrode;

a first terminal member resiliently contacting the first electrode;

a terminal portion of a first conductor contacting the first terminal member;

a second insulator covering the terminal portion of the first conductor;

a second terminal member contacting the second electrode; and a terminal portion of a second conductor contacting the second terminal member.

16. A capacitor connection structure comprising:

a capacitor circuit comprising:

a capacitor having an electrode;

a press-contact terminal member resiliently contacting on the electrode; and a terminal end of an insulated electric wire contacting the press-contact terminal member; and a flexible insulator completely enclosing the capacitor circuit, the flexible insulator including pressing means for pressing the insulated electric wire against the press contact terminal member.

* * * * *